US006870137B1

(12) United States Patent
Clapp

(10) Patent No.: US 6,870,137 B1
(45) Date of Patent: Mar. 22, 2005

(54) ARTIFICIAL TEARS CONTAINER WARMING APPARATUS

(76) Inventor: Michael G. Clapp, 11531 NW. 21st St., Pembroke Pines, FL (US) 33026

( * ) Notice: Subject to any disclaimer, the term of this patent is extended or adjusted under 35 U.S.C. 154(b) by 0 days.

(21) Appl. No.: 10/386,238

(22) Filed: Mar. 11, 2003

(51) Int. Cl.[7] ..... A47K 5/00; B67D 5/63
(52) U.S. Cl. ..... 219/433; 219/430
(58) Field of Search ..... 219/430, 432, 219/433

(56) References Cited

U.S. PATENT DOCUMENTS 4,256,697 A * 3/1981 Baldwin ..... 219/433
5,057,671 A 10/1991 Colson ..... 219/521
5,248,870 A 9/1993 Redal ..... 219/521
5,700,991 A 12/1997 Osbern ..... 219/430
5,924,303 A * 7/1999 Hodosh ..... 62/457.4
6,204,485 B1 3/2001 Williams ..... 219/429
6,417,498 B1 * 7/2002 Shields et al. ..... 219/433
6,437,295 B1 8/2002 Hogg et al. ..... 219/439
6,444,956 B1 9/2002 Witcher et al. ..... 219/429

* cited by examiner

*Primary Examiner*—Joseph Pelham
(74) *Attorney, Agent, or Firm*—Frank L. Kubler

(57) ABSTRACT

A warming apparatus for receiving and heating a product container includes a heating chamber having a chamber side wall and a chamber bottom wall defining a chamber having a chamber interior surface and a chamber port through which a product container is inserted into and removed from the chamber; a heating element adjacent to one of the chamber side wall and the chamber bottom wall, for heating a product container within the chamber; an apparatus circuit electrically connected to the heating element for supplying electric power to the heating element; a flexible chamber liner within the chamber for receiving a product container and deforming to the shape and size of the product container; and a flowable heat transfer substance retained by the chamber liner adjacent to the chamber interior surface for flowing as the chamber liner deforms to the shape and size of a product container.

17 Claims, 1 Drawing Sheet

ARTIFICIAL TEARS CONTAINER WARMING APPARATUS

BACKGROUND OF THE INVENTION

1. Field of the Invention

The present invention relates generally to the field of temperature control devices for maintaining products at temperatures suitable for use. More specifically the present invention relates to a warming apparatus for receiving and heating a container of artificial tears to a desired temperature for use by contact lens wearers and by dry eye suffers, and for maintaining the container at the desired temperature. The apparatus includes an apparatus housing containing a heating chamber having a chamber side wall and a chamber bottom wall together defining a chamber interior surface, and a container passing chamber port through which a container of artificial tears is inserted into and removed from the chamber; a heating element adjacent to the chamber, preferably between the housing and the chamber walls for heating a container within the chamber; a flexible chamber liner; and a flowable heat transfer substance retained between the chamber interior surface and the chamber liner. The liner defines a container receiving annulus or a pocket, sized relative to an artificial tears container such that the liner flexes and the heat transfer substance behind the liner flows so that the liner configuration deforms upon insertion of the container to snugly hug the container and thus to eliminate insulating air spaces or gaps around the container exterior and maximize the efficiency of heat transfer from the heating element into the container.

A thermostat and switch preferably are provided to control the operation of the heating element so that the container is maintained at a certain desired temperature or with a desired temperature range. A temperature limiting device preferably is also provided in conjunction with the thermostat, including a switch which automatically shuts off the heating element when the temperature reaches the upper end of a desired range. In this way the temperature of the container and its contents is maintained between upper and lower range limits. A timer with a timer display panel preferably is provided on the housing exterior including a timer setting control for activating the heating element at a desired time of day, such as early in the morning, and for a certain length of time.

2. Description of the Prior Art

There have long been heating devices for various types of bottles and other product containers. Some heating devices have had timers and thermostats for starting and stopping the heating. A problem with these prior heating devices has been that heating efficiency has been decidedly limited, due at least in part to heat loss through air gaps between the device heating surface and a product container within the heating device. Another problem has been that many of these devices have been configured to receive only product containers of one size and shape.

Witcher, et al., U.S. Pat. No. 6,444,956, issued on Sep. 3, 2002, discloses a hand lotion warmer into which several containers of various substances can be inserted. The heating element is a light bulb.

Hogg, et al, U.S. Pat. No. 6,437,295, issued on Aug. 20, 2002, reveals a lotion heating system including an open top vessel containing water, into which a lotion bottle is inserted. The vessel is heated by a heating plate.

Williams, U.S. Pat. No. 6,204,485, issued on Mar. 20, 2001, teaches a toothpaste warmer for receiving a toothpaste tube, Williams may include a ceramic heating element and a metal inner shell for enhancing heat conduction.

Osbern, U.S. Pat. No. 5,700,991, issued on Dec. 23, 1997, teaches a heating device for heating a gel container, including a tubular open topped heat exchanger vessel and a compartment below the heat exchanger vessel containing a heating coil. Osbern appears to fit only one size and shape of product container.

Colson, U.S. Pat. No. 5,057,671, issued on Oct. 15, 1991, discloses a solution warming unit for receiving multiple bottles. The bottles are inserted through bottle ports in the top of a heating vessel.

Redal, U.S. Pat. No. 5,248,870, issued on Sep. 28, 1993, reveals an electric heating device for warming the contents of bottles or other containers. One or more bottles are inserted through upper bottle ports into a heating chamber containing a light bulb heat source.

It is thus an object of the present invention to provide an artificial tears container warming apparatus which heats a quantity of artificial tears within the container in which the artificial tears are sold with high speed and efficiency to a suitable temperature for dispensing into the eye, and which receives and fits containers of several different shapes and sizes, and which may be adapted to receive and heat other types of product containers.

It is another object of the present invention to provide such an apparatus which optionally maintains the container and artificial tears contents at a desired temperature or within a desired temperature range, and which includes a maximum temperature limiting means.

It is still another object of the present invention to provide such an apparatus which optionally includes timer means for starting and ending the apparatus heating function at pre-set times of the day, and optionally on pre-set days of the week.

It is finally an object of the present invention to provide such an apparatus which is suitable for use in the home, the office or virtually any other location, which is compact, sturdy, safe to use, reliable and inexpensive to manufacture.

SUMMARY OF THE INVENTION

The present invention accomplishes the above-stated objectives, as well as others, as may be determined by a fair reading and interpretation of the entire specification.

A warming apparatus is provided for receiving and heating a product container, including a heating chamber having a chamber side wall and a chamber bottom wall defining a chamber having a chamber interior surface and a chamber port through which a product container is inserted into and removed from the chamber; a heating element adjacent to one of the chamber side wall and the chamber bottom wall, for heating a product container within the chamber; an apparatus circuit electrically connected to the heating element for supplying electric power to the heating element; a flexible chamber liner within the chamber for receiving a product container and deforming to the shape and size of the product container; and a flowable heat transfer substance retained by the chamber liner adjacent to the chamber interior surface for flowing as the chamber liner deforms to the shape and size of a product container; so that the configuration of the liner deforms upon insertion of a product container and snugly hugs the product container to eliminate insulating air spaces around the exterior of a product container within the chamber and thus maximizes the efficiency of heat transfer from the heating element into the container.

The apparatus preferably additionally includes a thermostat and switch assembly controlling operation of the heating element, so that a product container within the chamber is maintained within a desired temperature range. The apparatus preferably additionally includes a temperature limiting device including a switch in the apparatus circuit which automatically shuts off the heating element when the temperature reaches the upper end of a desired temperature range. The apparatus preferably additionally includes a timer circuit including a timer setting control for activating the heating element at a pre-set time of day and for a pre-set length of time. The apparatus preferably additionally includes a timer display panel.

The apparatus preferably yet additionally includes an operating indicator light connected to the apparatus circuit which illuminates to show that the apparatus is operating. A ready indicator light preferably is connected to the thermostat and switch assembly for signalling when a product container has reached a pre-set temperature. One of the operating indicator light and the ready indicator light is a light emitting diode.

The container passing port preferably has a substantially rounded diamond shape to closely receive and pass many different shapes of product containers so that space between the container passing port and the sides of a product container through which heated air may escape is minimized. The chamber preferably has a substantially rounded diamond shape in lateral cross-section to closely conform to various container configurations.

The liner optionally defines a self-contained heat transfer substance retaining structure in the form of a toroid. The liner preferably is formed of a slippery plastic, so that a product container can slide within the liner with minimal friction resistance. The heat transfer solution preferably has the consistency of a gel.

The apparatus preferably additionally includes an apparatus housing surrounding the chamber, where the heating element is located between the housing and the chamber. The heating element preferably is provided between the housing wall and the chamber. The housing preferably has one of: molded feet and a soft pads. The heating element preferably is constructed to operate at 110–120 volts the United States, or at 220–240 volts in Europe.

A warming apparatus is further provided for receiving and heating a product container, including a flexible liner for receiving a product container and deforming to the shape and size of the product container; a heating element adjacent the liner for heating a product container within the flexible liner; an apparatus circuit electrically connected to the heating element for supplying electric power to the heating element; and a flowable heat transfer substance retained by the flexible liner for flowing as the flexible liner deforms to the shape and size of a product container; so that the configuration of the liner deforms upon insertion of a product container and snugly hugs the product container to eliminate insulating air spaces around the exterior of a product container and the flexible liner and thus maximizes the efficiency of heat transfer from the heating element into the container.

A warming apparatus is yet further provided for receiving and heating a product container, including a heating chamber having a chamber side wall and a chamber bottom wall defining a chamber having a chamber interior surface and a chamber port through which a product container is inserted into and removed from the chamber; a heating element adjacent to one of the chamber side wall and the chamber bottom wall, for heating a product container within the chamber; an apparatus circuit electrically connected to the heating element for supplying electric power to the heating element; a thermostat and switch assembly controlling operation of the heating element, so that a product container within the chamber is maintained within a desired temperature range; and a timer circuit including a timer setting control for activating the heating element at a pre-set time of day and for a pre-set length of time.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
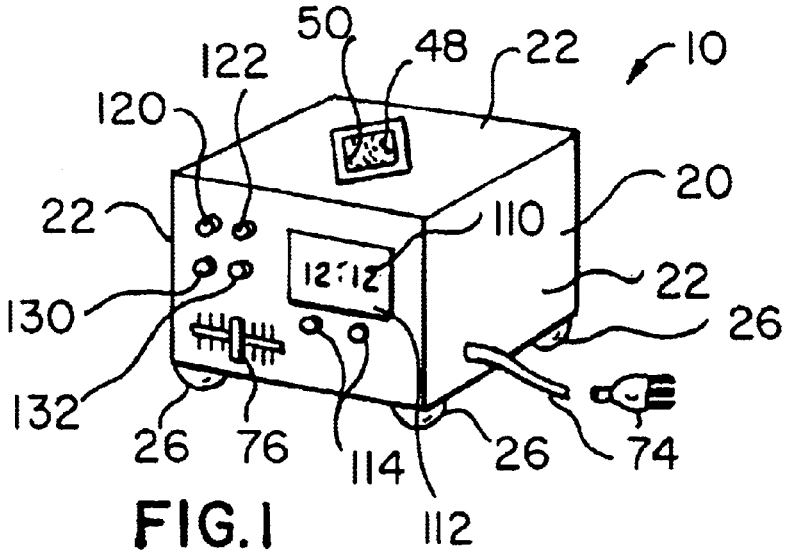
FIG. 1 is a perspective view of the preferred embodiment of the artificial tears container warming apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
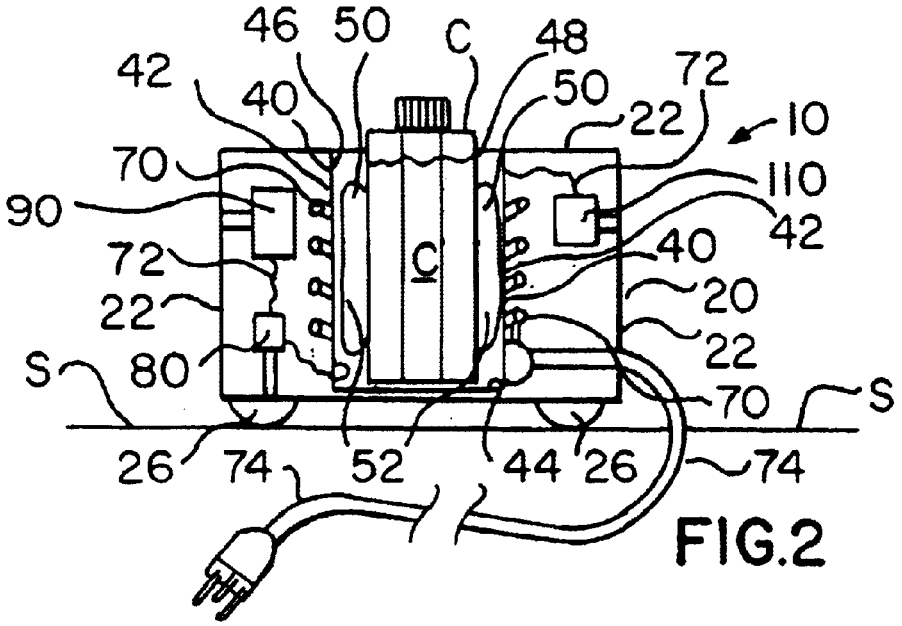
FIG. 2 is a cross-sectional front view of the apparatus of FIG. 1, showing the chamber, heating element, thermostat and various other apparatus circuit elements including the power cord. A product container is shown fitted into the chamber for heating.
Figure 3:
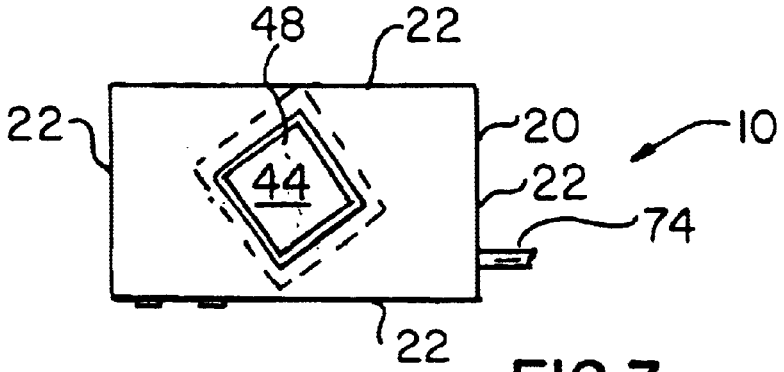
FIG. 3 is a top view of the apparatus of FIG. 1, showing the preferred diamond-shaped chamber opening.

Referring to FIGS. 1–3, a warming apparatus 10 is disclosed for receiving and heating a container C of artificial tears AT to a desired temperature. Apparatus 10 includes an apparatus housing having a housing wall 22, and containing a heating chamber 40 having a chamber side wall 42 and a chamber bottom wall 44 together defining a chamber interior having a chamber interior surface 46, and a chamber port 48 through which a container C of artificial tears AT is inserted into and removed from the chamber 40 interior; a heating element 70 adjacent to the chamber 40 and connected to an apparatus power circuit 72 connected to an apparatus power cord 74. The heating element preferably is located between the housing side wall 22 and chamber side wall 42 for heating the chamber 40 and thus heating a product container C within chamber 40; a flexible chamber liner 50, and a flowable heat transfer substance 52 retained by the chamber liner 50 adjacent to the chamber interior surface 46.

The liner 50 defines a container receiving annulus, or alternatively a pocket, sized relative to standard sizes of various artificial tears containers C such that the liner 50 flexes and the heat transfer substance 52 behind the liner 50 flows so that the liner 50 configuration deforms upon insertion of the container C into the liner 50 and the liner 50 snugly hugs the container C to eliminate insulating air spaces or gaps around the exterior of the chamber C and thus maximizes the efficiency of heat transfer from the heating element 70 into the container C. The heating element 70 may be outside the chamber 40 or within the chamber 40 adjacent the chamber interior surface 46. The intensity of heat produced by heating element 70 can be altered by a graduated switch 76.

A thermostat and switch assembly 80 are provided to control the operation of the heating element 70 so that the container C is maintained at a certain desired temperature or within a desired temperature range. A temperature limiting device 90 is also provided in conjunction with the thermostat and switch assembly 80, includes a switch (not shown) which automatically shuts off the heating element 70 when the temperature of the chamber 40 reaches the upper end of a desired range. In this way the temperature of the container C and its contents is maintained between upper and lower range limits. A timer 110 with a timer display panel 112 preferably is provided on the housing 20 exterior and includes a timer setting control 114 for activating the heating element 70 at a desired time of day, such as early in the morning, and for a certain length of time.

Apparatus 10 preferably further includes an operating indicator light 120 and circuit (not shown) which is illuminated to show that apparatus 10 is operating, whether resulting from plugging the power cord 74 into an outlet or from turning on a power switch (optional and not shown). In addition, a ready indicator light 130 is provided to signal when the chamber 40, and thus the container C, has reached a desired temperature, the operating and ready indicator lights 120 and 130 respectively, preferably being light emitting diodes (LED's). The ready indicator light 130 would normally fluctuate between on and off modes during apparatus 10 operation, as the temperature rises slightly above and then drops slightly below the minimum or maximum desired temperature. Rather than simply turning indicator lights on and off, alternate operating indicator lights 120 and 122 and alternate ready indicator lights 130 and 132 may activate, so that a change in the illuminated color resulting from one in the set deactivating and the other simultaneously activating indicates that the apparatus 10 is operating or that the minimum temperature has been reached. Red or orange preferably indicates heating prior to minimum temperature being reached, and green or yellow preferably indicates that the minimum temperature has been reached, although of course the use of many other colors is contemplated.

The chamber port 48 preferably has a rounded diamond shape to closely receive and pass many different shapes of artificial tears containers C so that space between the chamber port 48 and the sides of the container C through which heated air or radiated heat might escape is minimized. The chamber 40 and housing 20 preferably also have a rounded diamond shape in lateral cross-section to more closely conform to typical container C lateral cross-sectional configurations.

The preferred temperature to which apparatus 10 heats a product container C is approximately 85 degrees Fahrenheit, for maximum comfort for dispensing into user eyes. The liner 50 preferably defines a self-contained heat transfer substance 52 retaining structure in the form of a toroid or doughnut shape and preferably is formed of a plastic which is slippery so that a container C can slide within the liner 50 with minimal friction resistance. The artificial tears containers C themselves typically are bottles formed of plastic. The heat transfer solution 52 preferably has the consistency of a gel. The housing 20 and chamber 40 preferably are formed of a hard plastic. The housing 20 preferably is elevated from an apparatus support surface S by molded feet 26 or soft pads. The heating element 70 preferably operates on standard household current, typically 110–120 volts in the United States and 220–240 volts in European and a number of other countries. Embodiments of apparatus 10 are contemplated which exclude the housing 20, and other embodiments which additionally exclude the chamber 40, so that the primary structural parts are the closed, toroidal liner and the heating element 70.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A warming apparatus for receiving and heating a product container, comprising:

a heating chamber having a chamber side wall and a chamber bottom wall defining a chamber having a chamber interior surface and a chamber port through which a product container is inserted into and removed from said chamber;

a heating element adjacent to one of said chamber side wall and said chamber bottom wall, for heating a product container within said chamber;

an apparatus circuit electrically connected to said heating element for supplying electric power to said heating element;

a flexible chamber liner within said chamber for receiving a product container and deforming to the shape and size of the product container, said liner defining a self-contained heat transfer substance retaining structure in the form of a toroid;

and a flowable heat transfer substance retained by said chamber liner adjacent to said chamber interior surface for flowing as said chamber liner deforms to the shape and size of a product container;

such that the configuration of said liner deforms upon insertion of a product container and snugly hugs the product container to eliminate insulating air spaces around the exterior of a product container within said chamber and thus maximizes the efficiency of heat transfer from said heating element into the container.

2. The apparatus of claim 1, additionally comprising a thermostat and switch assembly controlling operation of said heating element, such that a product container within said chamber is maintained within a desired temperature range.

3. The apparatus of claim 1, additionally comprising a temperature limiting device comprising a switch in said apparatus circuit which automatically shuts off said heating element when the temperature reaches the upper end of a desired temperature range.

4. The apparatus of claim 3, additionally comprising a timer means comprising a timer setting control for activating said heating element at a pre-set time of day and for a pre-set length of time.

5. The apparatus of claim 4, additionally comprising a timer display panel.

6. The apparatus of claim 1, additionally comprising an operating indicator light connected to said apparatus circuit which illuminates to show that said apparatus is operating.

7. The apparatus of claim 2, additionally comprising a ready indicator light connected to said thermostat and switch assembly for signalling when a product container has reached a pre-set temperature.

8. The apparatus of claim 7, wherein one of said operating indicator light and said ready indicator light is a light emitting diode.

9. The apparatus of claim 1, wherein said liner is formed of a slippery plastic, such that a product container can slide within said liner with minimal friction resistance.

10. The apparatus of claim 1, wherein said heat transfer solution has the consistency of a gel.

11. The apparatus of claim 1, additionally comprising an apparatus housing surrounding said chamber, wherein said heating element is located between said housing and said chamber.

12. The apparatus of claim 1, wherein said heating element is constructed to operate at 110–120 volts.

13. The apparatus of claim 1, wherein said heating element is constructed to operate at 220–240 volts.

14. A warming apparatus for receiving and heating a product container, comprising:

a heating chamber having a chamber side wall and a chamber bottom wall defining a chamber having a chamber interior surface and a chamber port through which a product container is inserted into and removed from said chamber, said chamber port having a substantially rounded diamond shape to closely receive and pass many different shapes of product containers such that space between said container passing port and sides of a product container through which heated air may escape is minimized;

a heating element adjacent to one of said chamber side wall and said chamber bottom wall, for heating a product container within said chamber;

an apparatus circuit electrically connected to said heating element for supplying electric power to said heating element;

a flexible chamber liner within said chamber for receiving a product container and deforming to the shape and size of the product container;

and a flowable heat transfer substance retained by said chamber liner adjacent to said chamber interior surface for flowing as said chamber liner deforms to the shape and size of a product container;

such that the configuration of said liner deforms upon insertion of a product container and snugly hugs the product container to eliminate insulating air spaces around the exterior of a product container within said chamber and thus maximizes the efficiency of heat transfer from said heating element into the container.

15. A warming apparatus for receiving and heating a product container, comprising:

a heating chamber having a chamber side wall and a chamber bottom wall defining a chamber having a chamber interior surface and a chamber port through which a product container is inserted into and removed from said chamber, wherein said chamber has a substantially rounded diamond shape in lateral cross section to closely conform to various container configurations;

a heating element adjacent to one of said chamber side wall and said chamber bottom wall, for heating a product container within said chamber;

an apparatus circuit electrically connected to said heating element for supplying electric power to said heating element;

a flexible chamber liner within said chamber for receiving a product container and deforming to the shape and size of the product container;

and a flowable heat transfer substance retained by said chamber liner adjacent to said chamber interior surface for flowing as said chamber liner deforms to the shape and size of a product container;

such that the configuration of said liner deforms upon insertion of a product container and snugly hugs the product container to eliminate insulating air spaces around the exterior of a product container within said chamber and thus maximizes the efficiency of heat transfer from said heating element into the container.

16. A warming apparatus for receiving and heating a product container, comprising:

a heating chamber having a chamber side wall and a chamber bottom wall defining a chamber having a chamber interior surface and a chamber port through which a product container is inserted into and removed from said chamber;

a heating element adjacent to one of said chamber side wall and said chamber bottom wall, for heating a product container within said chamber;

an apparatus circuit electrically connected to said heating element for supplying electric power to said heating element;

a flexible chamber liner within said chamber for receiving a product container and deforming to the shape and size of the product container;

and a flowable heat transfer substance retained by said chamber liner adjacent to said chamber interior surface for flowing as said chamber liner deforms to the shape and size of a product container;

an apparatus housing having a housing wall surrounding said chamber, wherein said heating element extends between said housing wall and said chamber;

such that the configuration of said liner deforms upon insertion of a product container and snugly hugs the product container to eliminate insulating air spaces around the exterior of a product container within said chamber and thus maximizes the efficiency of heat transfer from said heating element into the container.

17. The apparatus of claim 16, wherein said housing additionally comprises one of: molded feet and soft pads.

* * * * *